United States Patent [19]

Lupton

[11] 4,129,392

[45] Dec. 12, 1978

[54] ROLLING CUTTER ARRANGEMENT

[75] Inventor: Homer B. Lupton, Mercer Island, Wash.

[73] Assignee: Subterranean Tools Inc., Denver, Colo.

[21] Appl. No.: 889,722

[22] Filed: Mar. 24, 1978

[51] Int. Cl.[2] ..... E21B 9/12

[52] U.S. Cl. ..... 403/25; 308/8.2; 175/364

[58] Field of Search ..... 175/364, 363, 362, 361; 308/8.2, 15; 403/24, 25, 373, 374, 8, 21, 356; 29/426

[56] References Cited

U.S. PATENT DOCUMENTS

| | | | |
|---|---|---|---|
| 3,612,196 | 10/1971 | Dixon | 175/364 |
| 3,835,944 | 9/1974 | Bingham | 175/364 |
| 3,836,271 | 9/1974 | Coski | 403/355 |
| 3,851,718 | 12/1974 | Fink | 175/363 |
| 3,863,994 | 2/1975 | Fink | 403/362 X |

*Primary Examiner*—Andrew V. Kundrat
*Attorney, Agent, or Firm*—Lawrence R. Burns

[57] ABSTRACT

A mounting structure for rolling cutter assemblies, especially gauge cutters, is disclosed wherein a saddle on a support structure is provided with a first sloping wall, a base portion joining said sloping wall and an abutment region facing the sloping wall. A wedge block is seated on the base portion of the saddle and has a second sloping wall facing and converging with the first sloping wall. The ends of the rolling cutter shaft have side walls that also converge and these side walls abuttingly engage the first and second sloping walls. Means are provided for holding and urging said shaft on to said saddle. The rolling cutter and shaft assembly may be easily removed by removal of the fastener means and wedge block. The disclosed saddle seat arrangement provides for an easy method of replacement of the rolling cutter assembly while the cutter head is still in the bore hole formation.

4 Claims, 5 Drawing Figures

ROLLING CUTTER ARRANGEMENT

BACKGROUND OF THE INVENTION

This invention relates generally to tunneling or earth boring machines having a rotatable cutter head and rolling cutters mounted on the cutter head. Particularly, the invention relates to the saddle seat arrangements provided between the cutter head and the rolling cutter assemblies that hold the rolling cutter firmly during cutting operations and yet provide for quick replacement of a rolling cutter assembly when necessary. Specifically, the present invention relates to a saddle seat arrangement for mounting of rolling cutter assemblies on the sides of a cutter head in order to maintain the gauge of the bore hole.

Earth boring and tunneling machines, especially raise boring machines, utilize gauge cutters mounted vertically on the sides of the cutter head structure to maintain a uniform diameter along the length of a bore hole. Such rolling cutter assemblies, such as gauge rollers, must be appropriately attached to the cutter head assembly so as to be firmly supported during cutting operations and, yet, the attachment between the rolling cutter head and rolling cutter assembly must provide for ease of replacement when the cutting teeth of the rolling cutter assembly become worn.

Replacement of the rolling cutter assemblies is usually faciliated on site at the bore hole location and, in many cases, it is preferable to replace the rolling cutter assemblies with the cutter head still in the bore hole.

Saddle seat arrangements for rolling cutter assemblies are illustrated by U.S. Pat. Nos. 3,612,196, 3,851,718 and 3,863,994 which are concerned with the problem of firmly supporting the rolling cutter assembly during cutting operations and, yet, providing for ease of replacement when the rolling cutter assemblies become worn.

These prior art arrangements, and others, however, do not specifically address or solve the problem of providing a saddle seat arrangement for a gauge rolling cutter assembly that facilitates replacement when the cutter head is still in the bore hole.

BRIEF SUMMARY OF THE INVENTION

According to the present invention, a saddle seat arrangement is provided that facilitates removal of gauge rolling cutter assemblies when the cutter head is still in the bore hole. A saddle is provided, and preferably welded, on the structure of the cutter head for receiving the rolling cutter assembly. The saddle seats are spaced apart in the structure in pairs so as to receive and support the shaft upon which the rolling cutter assemblies are rotatably mounted. Opposing ends of the shaft engage the saddle seats on the cutter head structure.

The saddles on the cutter head structure are comprised of a base portion, with a first sloping wall on one side and an abutment region on the other side of the base portion. Each of the ends of the shaft that support the rolling cutter assemblies have side walls that converge in one direction. A wedge block is provided and seats on the base portion of the saddle, the wedge block having a second sloping wall which faces and converges with the first sloping wall when the wedge block is in position on the base portion of the saddle.

The rolling cutter assembly is mounted on the cutter head with the converging side walls of the shaft ends mating and abutting the first and second sloping walls of the saddle and wedge block respectively. Means urging and holding said shaft ends in engagement with said cutter head are provided, preferably by bolt means which extend through the ends of the shaft and threadedly engage the cutter head structure.

Correct dimensioning of the shaft ends, wedge block and saddle seat should allow for easy replacement of the rolling cutter assembly on the cutter head, especially when used as a gauge cutter assembly, and the cutter head is still in the bore hole.

The method used to remove the gauge roller cutter having the above described saddle seat arrangement first requires releasing the holding means urging the shaft ends into engagement with the cutter head. Once this is done, the wedge block assembly can be moved longitudinally in either direction along a line substantially parallel with the centerline of the shaft so as to disengage the wedge block from the abutment region and one of the converging sloping walls of the shaft ends.

Once the wedge block has been removed from the saddle seat arrangement, the rolling cutter shaft can be rotated until one of the converging side walls on the ends of the shaft becomes substantially parallel with the base portion of the saddle.

When dimensioned correctly, clearance between the shaft and the abutment region wall will permit the specially configured shaft end to be moved laterally over and out of engagement with the saddle seat without movement of the entire rolling cutter assembly.

It is an object of the present invention to provide a strong and effective saddle seat arrangement for gauge cutter assemblies that facilitates replacement of the cutter assemblies when the cutter head is still in the bore hole formation.

It is a further object of the present invention to provide a saddle seat arrangement that is very simple in operation and provides an easy method of removal and replacement of gauge cutters on cutter head assemblies.

The exact nature of the present invention will become more clearly apparent upon reference to the following detailed specification taken in connection with the accompanying drawings in which:

DETAILED DESCRIPTION OF THE INVENTION

Figure 1:
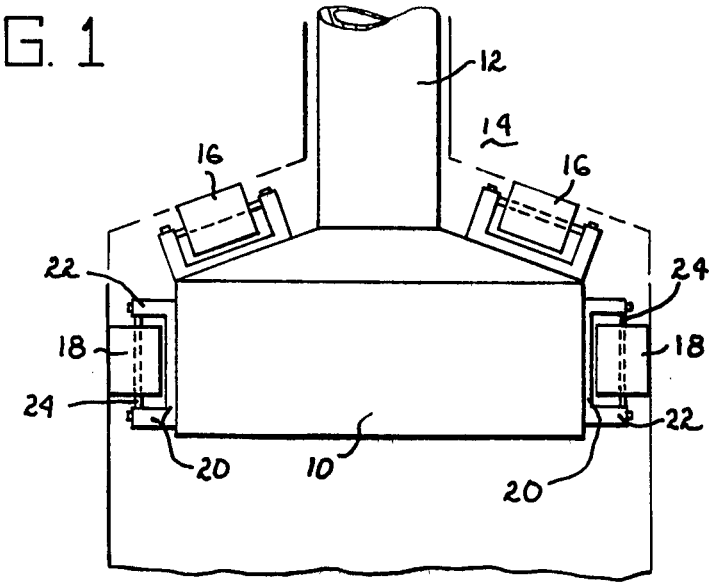
FIG. 1 is a cut away side view of a raise boring cutter head structure in bore hole formation.

Referring to the drawings somewhat more in detail, shown in FIG. 1 is a rotatable cutter head structure 10 which is fastened to the lower end of a drill string arrangement 12 and is acting against a bore hole formation 14. When used with raise boring equipment, the drill string 12 is rotated by machinery located on the surface of the earth, not shown, and the drill string 12 pulls the cutter head structure 10 upward during rotation.

Rolling cutter assemblies 16 are mounted on the upper part of cutter head structure 10 so as to reduce the earth formation as the cutter head structure 10 advances upward in earth formation 14.

While the bore hole formation formed by the raise boring operation is being formed, it is desirable to maintain as constant a diameter as possible along the axial length of the bore hole. In order to achieve this, gauge rolling cutter assemblies 18 are mounted on the sides of the cutter head 10. Saddles 20 are attached to the cutter head structure and have dependent legs 22 formed thereon for holding and supporting the gauge rolling cutter assemblies 18 during the earth boring operations.

The legs 22 usually grasp the ends of the shafts 24 of the gauge rolling cutters 18 and hold them secure to the cutter head structure 10. Often, it is desirable that gauge rolling cutters 18 be replaced with the cutter head structure 10 still in the bore formation and, as can be seen in FIG. 1, gauge rolling cutters 18 are not left with any clearance in which they may be moved outward so as to disengage the legs 22 of the saddles 20.

The present application provides a saddle arrangement which facilitates the removal and replacement of the gauge rolling cutters 18.

Figure 2:
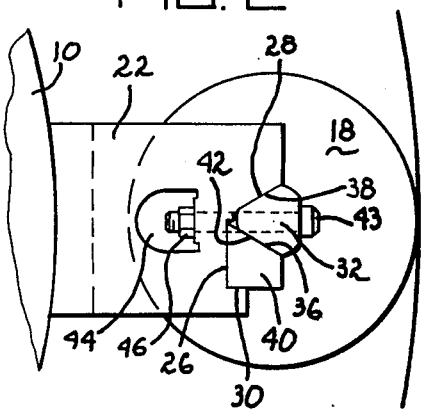
FIG. 2 is an end view of one saddle leg arrangement according to the present invention.

Shown more clearly in FIG. 2 is an upstanding leg 22 of the saddle 20 which is connected to the cutter head 10. Saddle leg 22 has formed therein a base portion 26 having on one side a first sloping wall 28 and on the other side an abutment region 30. The first sloping wall 28 and the abutment region 30 face each other.

Gauge rolling cutter assembly shaft 24 has opposing ends 32 formed thereon and end 32 has two converging sides 36 and 38 formed thereon. A wedge member 40 is formed having a second sloping wall 42 which faces the first sloping wall 28 when wedge member 40 is seated upon base portion 26 of saddle leg 22.

The gauge rolling cutter assemblies 18 are then mounted upon spaced apart legs 22 of saddle 20, preferably such that the converging sides formed on shaft end 32 converge in a direction toward the cutter head structure 10. The converging walls of the shaft end 32 are abutted against the first and second sloping walls 28 and 42 and means urging and holding said shaft ends 32 are furnished so as to firmly affix the gauge rolling cutters 18 to cutter head structure 10.

The means for holding said shaft ends 32 to saddle legs 22 are preferably bolt means 43 which extend through the shaft end 32 and threadingly engage saddle leg 22. Shown in FIG. 2 is a transverse aperture 44 formed in saddle leg 22 such that the bolt means 43 has a threaded end which extends into the region of aperture 44 and nut 46 threadedly engages bolt 43 and seats upon a portion of saddle leg 22.

Figure 3:
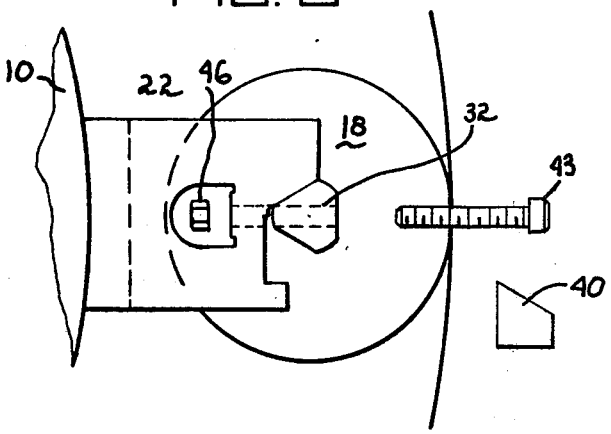
FIGS. 3, 4 and 5 are views of the arrangement according to FIG. 2 in various stages of disassembly.
Figure 4:
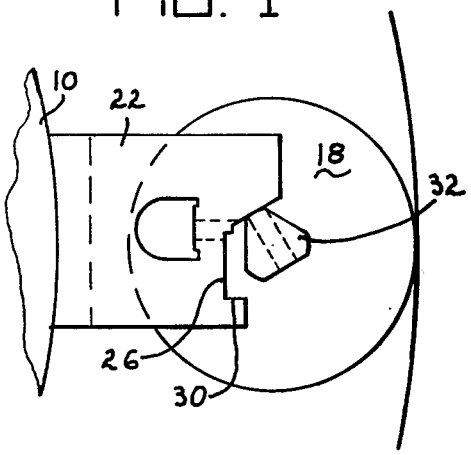
Figure 5:
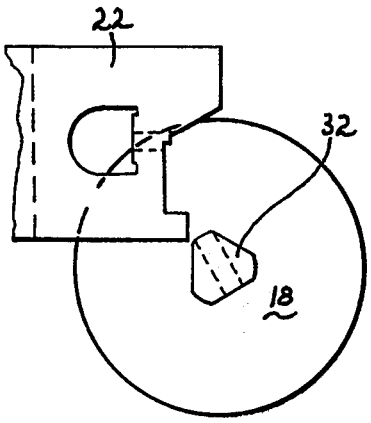

Shown in FIGS. 3, 4 and 5 is an end view of the saddle arrangement shown in various stages of disassembly. As mentioned previously, it is sometimes desired to remove and replace gauge roll assemblies 18 while cutter head 10 is in the bore hole formation. When this is desired, as can be seen in FIG. 1, gauge cutter assemblies 18 have no clearance between them and the side of the bore hole formation which would allow movement so that the shaft could be disengaged from the saddle legs supporting them.

With the arrangement according to the present invention, and as shown in FIG. 3, the wedge block 40 may be removed from the saddle leg 22 by, first, disengaging bolt means 43 from nut 46 which may be captively held within saddle leg 22. Once the fastening means has been released, wedge block 40 may be moved in either direction along a line parallel to the centerline of the gauge rolling cutter 18.

With reference to FIG. 1, the wedge block 40 may be moved up or down until the wedge block is completely disengaged from saddle leg 22.

Referring again to FIG. 3, it should be noted that the shaft end 32 is specifically configured and preferably has a triangular like shape comprising at least three planar walls, any two of which may be the converging walls 36 and 38 indicated in FIG. 2.

Referring now to FIG. 4, it can be seen that the shaft end 32 may then be rotated until one of its planar converging sides is substantially parallel in the base portion 26 of saddle leg 22. When dimensioned correctly, the height of the abutment region 30 should be set so that the rolling cutter shaft end 32, when in its rotated position, is further from the base portion 26 than the top of the abutment region 30.

When this is done, as is shown in FIG. 5, the gauge rolling cutter 18, with its shaft end 32, may be moved completely out of engagement with saddle leg 22. When this is done, the entire gauge rolling cutter 18 may be taken away and a new gauge rolling cutter 18 may be mounted on the cutter head structure 10.

Modifications may be made within the scope of the appended claims.

What is claimed is:

1. A mounting arrangement for a rolling cutter, especially a gauge cutter, which comprises; a saddle having a first sloping wall, a base portion joining said first sloping wall and an abutment region facing said first sloping wall, said rolling cutter having a shaft whose ends have converging side walls, a wedge block seated on said base portion of said saddle and having a second sloping wall converging with and facing said first sloping wall, said wedge block held in a predetermined position relative to said first sloping wall by backing on said abutment region on said saddle, said converging side walls of said shaft ends mating with said first and second converging sloping walls and means holding and urging said shaft ends to said saddles, and said rolling cutter shaft ends converging toward said saddle when said rolling cutter is mounted on said saddle and said first and second sloping walls converging toward said saddle.

2. The mounting arrangement according to claim 1 wherein said rolling cutter shaft ends when viewed in cross section have at least three corner portions with the adjoining side walls converging toward one another.

3. The mounting arrangement according to claim 1 wherein said means holding and urging said shaft ends to said saddles comprises fastener means extending through said shaft and connecting to said saddles.

4. The method of removing a rolling gauge cutter and shaft assembly from a saddle on a support member while in a bore hole which comprises the steps of removing the fastener means urging and holding said shaft to said saddle, rotating said shaft into a predetermined clearance position, and while holding said shaft in said position, sliding said rolling cutter along on the gauge surface until said shaft clears said saddle.

* * * * *